US005971707A

United States Patent [19]

Uematsu et al.

[11] Patent Number: 5,971,707

[45] Date of Patent: Oct. 26, 1999

[54] GAS TURBINE MOVING BLADE STEAM COOLING SYSTEM

[75] Inventors: Kazuo Uematsu; Rintaro Chikami; Yasuoki Tomita; Hiroki Fukuno; Sunao Aoki; Toshiaki Sano; Yukihiro Hashimoto; Kiyoshi Suenaga; Kazuharu Hirokawa, all of Takasago, Japan

[73] Assignee: Mitsubishi Heavy Industries, Ltd., Tokyo, Japan

[21] Appl. No.: 09/109,379

[22] Filed: Jul. 2, 1998

[30] Foreign Application Priority Data

Jul. 7, 1997 [JP] Japan ..... 9-181205
Jul. 11, 1997 [JP] Japan ..... 9-186539

[51] Int. Cl.[6] ..... B65H 1/14; F01D 5/08

[52] U.S. Cl. ..... 416/96 R

[58] Field of Search ..... 416/95, 96 R, 416/96 A, 97 R, 219 R, 220 R

[56] References Cited

U.S. PATENT DOCUMENTS

| | | | |
|---|---|---|---|
| 2,931,623 | 4/1960 | Hyde | 416/96 R X |
| 2,974,925 | 3/1961 | Freche et al. | 416/95 X |
| 3,370,830 | 2/1968 | Nickles et al. | 416/95 |
| 3,715,170 | 2/1973 | Savage et al. | 416/97 R X |
| 4,019,831 | 4/1977 | Franklin et al. | 416/97 R |
| 4,118,136 | 10/1978 | Corsmeier et al. | 416/96 R X |
| 4,136,516 | 1/1979 | Corsmeier | 416/96 R X |
| 4,648,799 | 3/1987 | Brown et al. | 416/96 R X |
| 5,318,404 | 6/1994 | Carreno et al. | 416/96 R |
| 5,536,143 | 7/1996 | Jacala et al. | 416/96 R |

FOREIGN PATENT DOCUMENTS

| | | | |
|---|---|---|---|
| 6-257403 | 9/1994 | Japan . | |
| 2224082 | 4/1990 | United Kingdom | 416/96 R |

*Primary Examiner*—John Ryznic
*Attorney, Agent, or Firm*—Wenderoth, Lind & Ponack, L.L.P.

[57] ABSTRACT

A gas turbine moving blade steam cooling system in which leakage of steam for cooling a moving blade is prevented and thermal stress at a blade root end portion is mitigated. Each end portion of a blade root portion (3) of the moving blade (1) is projected so as to form a projection portions (4*a*, 4*b*). A steam passage 5 is provided between the projection portions (4*a*, 4*b*) and a steam supply port 5*a* and a steam recovery port (5*b*) are provided downwardly with the respect to the steam passage 5. The steam supply port (5*a*) connects to a steam supply passage (20) and the steam recovery port (5*b*) connects to a steam recovery passage (21). Steam is supplied from the steam supply port (5*a*) into a blade interior and is recovered through the steam recovery port (5*b*). Side surface seal plates (6, 7 and 8) are provided for preventing steam leakage. The steam cools the moving blade (1) and can be recovered without leakage and stress concentration due to heat at the projection portions (4*a*, 4*b*) of the blade root end portion.

11 Claims, 9 Drawing Sheets

GAS TURBINE MOVING BLADE STEAM COOLING SYSTEM

BACKGROUND OF THE INVENTION

1. Field of the Invention

The present invention relates to a gas turbine moving blade steam cooling system, and more specifically to a structure thereof which is able to prevent strength reduction of blade root portion and also to prevent steam leakage.

2. Description of the Related Art

FIG. 8 is a cross sectional view of a prior art gas turbine interior and shows flows of cooling air in a moving blade portion. In FIG. 8, numeral 50 designates a stationary blade, numeral 51 designates an outer shroud and numeral 52 designates an inner shroud. Numeral 60 designates a moving blade, which is fixed to a blade root portion 62 of a turbine disc 61 and rotates between stationary blades 50.

In the prior art gas turbine so constructed by the stationary blade 50 and the moving blade 60, the moving blade 60 is cooled by air which is a part of rotor cooling air. That is, there is bored a radial hole 65 in the blade root portion 62 and the rotor cooling air 100 is introduced into each disc cavity 64 to be further introduced into a lower portion of a platform 63 via the radial hole 65 and then is supplied into the moving blade 60.

FIG. 9 is a cross sectional view of a moving blade portion and a stationary blade portion of the gas turbine shown in FIG. 8. In FIG. 9, numeral 50 designates a stationary blade, which has an outer shroud 51 and an inner shroud 52 as well as an air pipe 53 extending in a blade height direction and passing through the blade interior. Seal air 110 is fed through the air pipe from the outer shroud 51 side into a cavity 54 so that pressure in the cavity 54 is made higher than that in a combustion gas passage and the seal air 110 further flows through a hole 57 and is partially discharged from a passage 56 so that a high temperature gas is prevented from coming therein. Numeral 55 designates a labyrinth seal, which is also for sealing the high temperature gas.

As for the cooling air for the moving blade 60, the mentioned rotor cooling air 100 is introduced into the disc cavity 64 to be further introduced into a shank portion 66 of a lower portion of the platform 63 via a radial hole 65 which passes through the interior of a rotor disc blade root portion 62 and then is supplied into a cooling air passage in the moving blade 60. Further, in place of using a portion of the rotor cooling air, it takes place also that air from a compressor is cooled by a cooler and is introduced into a disc cavity 64.

As mentioned above, the conventional process of cooling the gas turbine blades is air cooling and, especially for the moving blades, a portion of the rotor cooling air is introduced so as to be used for cooling thereof. In recent years, a steam cooling method is being developed in order to effect steam cooling of the rotor system, and it is imperative to employ such a structure that steam leakage is prevented sufficiently and the blade root portion, in which steam passages are provided, may adequately withstand thermal stress.

Further, in the case of air cooling, there occurs a lot of air leakage when the cooling air enters the moving blade from the disc which results in a loss of cooling air, while, in the case of steam cooling of the moving blade, there is no such loss of cooling air but if the steam escapes, a large amount of steam on the boiler side is lost which affects the performance greatly.

Also, in the moving blade of the air cooling method, there occurs stress concentration at a through hole portion of the radial hole between the blade root portion and a blade base portion so as to be affected by thermal stress. Hence, in order to employ steam cooling, it is necessary to consider a structure which avoids the stress concentration.

SUMMARY OF THE INVENTION

In order to employ steam cooling of a moving blade, therefore, it is a first object of the present invention to provide a gas turbine moving blade steam cooling system which is able to greatly reduce steam leakage from steam supply passages between a blade root portion and a disc as well as to prevent strength lowering of end portions of the blade root portion due to thermal stress.

Also, it is a second object of the present invention to provide a gas turbine moving blade steam cooling system, in addition to the system mentioned above, which is able to facilitate the maintenance work of inspection, repair and the like of passages through which steam is supplied from the blade root portion to the moving blade so that solution of the first object may be secured.

Further, it is a third object of the present invention to provide a gas turbine moving blade steam cooling system, in addition to the system mentioned above, which is able to reliably prevent steam leakage so that solution of the first object may be facilitated.

Further, it is a fourth object of the present invention to provide a gas turbine moving blade steam cooling system which is able to enhance the sealing function at a joint portion between a steam passage on the turbine disc side and that on the blade side so that practicability of the steam cooling method may be secured and advanced largely.

In order to attain said objects, the present invention provides the following:

(1) A gas turbine moving blade steam cooling system, in which a moving blade is fitted to a blade root portion via a platform. A projection portion is provided and projects from each end along a turbine axial direction of an upper portion of the blade root portion which is under the platform. Also, a steam passage, provided along the turbine axial direction between each projection portion, communicates with a steam passage of the moving blade and has a steam supply port provided downwardly in one of the projection portions. A steam recovery port is provided downwardly in the projection portion thereof so that the steam supply port and the steam recovery port are connected to a steam supply passage and a steam recovery passage, respectively, on a disc side.

(2) The gas turbine moving blade steam cooling system above, is provided with a demountable joint pipe at each of said steam supply port and said steam recovery port of the steam passage so that a lower portion of each joint pipe is connected to the steam supply passage and the steam recovery passage, respectively.

(3) The gas turbine moving blade steam cooling system above, is provided with a seal plate for sealing each side surface and therebetween along a turbine rotational direction of each projection portion of mutually adjacent moving blade.

(4) A gas turbine moving blade steam cooling system include a pipe-like joint which causes a steam supply passage or a steam recovery passage provided in a disc portion to communicate with a steam passage provided in a blade root portion. An O-ring is provided on a turbine rotational center side of a seal point of the pipe-like joint and a bush is provided on the turbine rotational center side of the O-ring so as to abut on the O-ring.

According to the present invention as set forth above, cooling steam for the moving blade enters the steam passage from the steam supply passage on the disc side via the steam supply port to pass through the blade interior from the steam passage while cooling the blade and then returns to the steam recovery port of the steam passage to pass through the steam recovery passage on the disc side so as to be recovered. Hence, the steam, while cooling the blade, receives heat without leakage of steam to be heated to a high temperature and is recovered to be used effectively. Thus, differently from the prior art wherein air is used for cooling and the air which has been heated to a high temperature is discharged, a large heat loss is eliminated.

Also, according to the present invention as set forth above, projection portion does not have small corner portion, and the steam supply port and the steam recovery port of the steam passage are provided in each projection portion. Hence, stress concentration due to heat at the blade root portion is eliminated and the end portions thereof and strength reduction at these portions can be prevented.

According to the present invention as set forth above, there is provided a demountable joint pipe, hence inspection, repair and replacement of the steam passages become facilitated and reliability of the steam cooling system of the moving blade is enhanced.

According to the present invention as set forth above, there is provided a seal plate for sealing each side face and therebetween of each said projection portion of mutually adjacent moving blades, hence leakage of steam can be prevented securely so that loss of steam is reduced and unfavorable influence of the gas passages due to leakage of steam is reduced.

DESCRIPTION OF THE PREFERRED EMBODIMENTS

Figure 1:
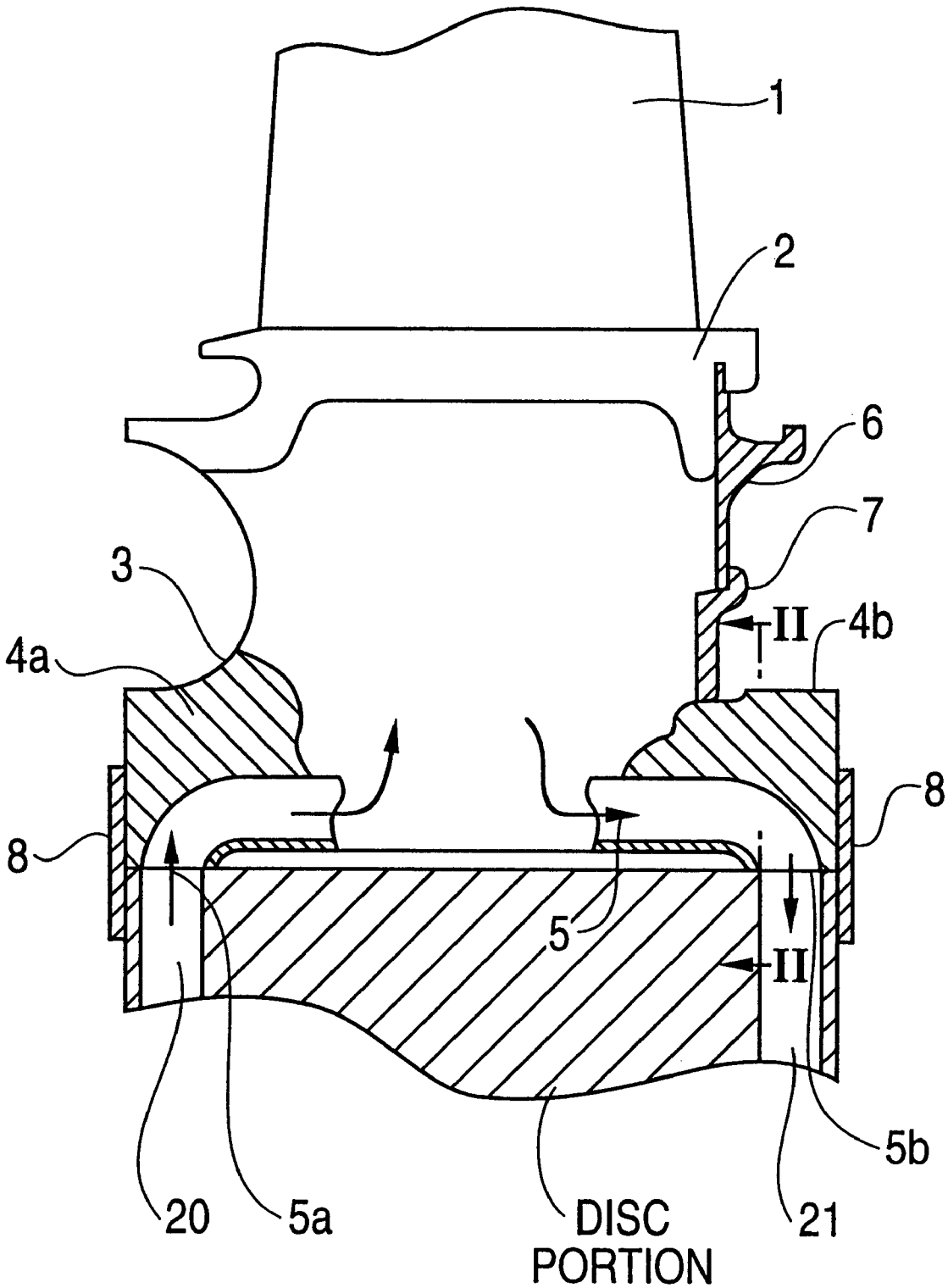
FIG. 1 is a cross sectional view of a blade root portion which is applied to a gas turbine moving blade steam cooling system of a first embodiment according to the present invention.

Herebelow, embodiments, according to the present invention will be described with reference to the figures. FIG. 1 is a cross sectional view of a blade root portion which is applied to a gas turbine moving blade steam cooling system of a first embodiment according to the present invention and FIG. 2 is a cross sectional view taken on line II—II of FIG. 1.

In FIG. 1, numeral 1 designates a moving blade, numeral 2 designates a platform, numeral 3 designates a blade root portion and numeral 4*a,* 4*b* designates a projection portion at each end along a turbine axial direction of the blade root portion 3 of mutually adjacent moving blades. Numeral 5 designates a steam passage, which extends between the projection portions 4*a* and 4*b* and communicates with a steam passage, not shown, leading to the blade interior from a lower portion of the moving blade 1. The steam passage 5 is provided at its end on a projection portion 4*a* side with a steam supply port 5*a* directed downwardly and at its end on a projection portion 4*b* side with a steam recovery port 5*b* directed downwardly. Here, the steam supply port 5*a* and the steam recovery port 5*b* may be arranged in reverse positions. Also, numerals 6, 7 and 8 designate seal plates for sealing each blade root portion 3 and between mutually adjacent moving blades.

Figure 2:
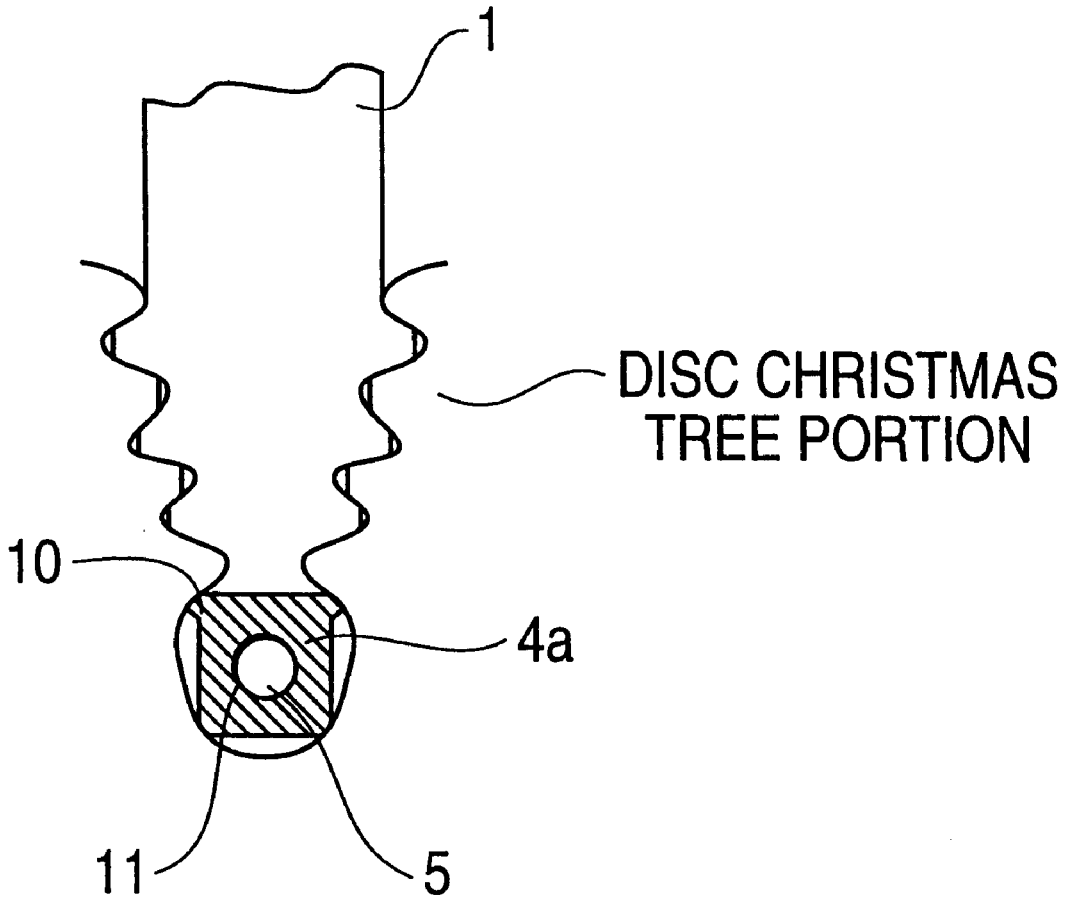
FIG. 2 is a cross sectional view taken on line II—II of FIG. 1.

As shown in FIG. 2, unit 10 of the steam passage 5 is fitted between adjacent blade root portions 3 so as to come in close contact with curved surfaces of the blade root portions 3 and is provided within its interior with a hole 11 through which steam passes. Also, the steam supply port 5*a* connects to a steam supply passage 20 provided in a disc portion and the steam recovery port 5*b* connects to a steam recovery passage 21 also provided in the disc portion.

In the first embodiment mentioned above, cooling steam is supplied from the steam supply passage 20 in the disc portion to flow through the steam supply port 5*a* and the steam passage 5 in the projection portion 4*a* and enters the lower portion of the moving blade 1 so as to pass through a steam passage in the blade, not shown, while cooling the blade. Then the cooling steam returns to the steam passage 5 in the projection portion 4*b* to be recovered through the steam recovery port 5*b* and the steam recovery passage 21 in the disc portion.

According to the first embodiment mentioned above, the steam passage 5 communicates respectively with the steam supply passage 20 and the steam recovery passage 21, both provided in the disc portion, and further the steam supply side and the steam recovery side between adjacent blade root portions are sealed by seal plates 8, respectively, hence leakage of steam is prevented and loss of steam is reduced.

Also, a structure is employed such that each end portion along the turbine axial direction of the blade root portion 3 is projected, as compared with the prior art, so as to form the projection portions 4*a,* 4*b* in which corner portions thereof are rounded and the steam supply port 5*a* and the steam recovery port 5*b* of the steam passage 5 are provided downwardly relative to the steam passage 5 in the projection portions 4*a* and 4*b,* respectively, hence unfavorable influence due to stress concentration caused by heat at these portions can be mitigated.

Figure 3:
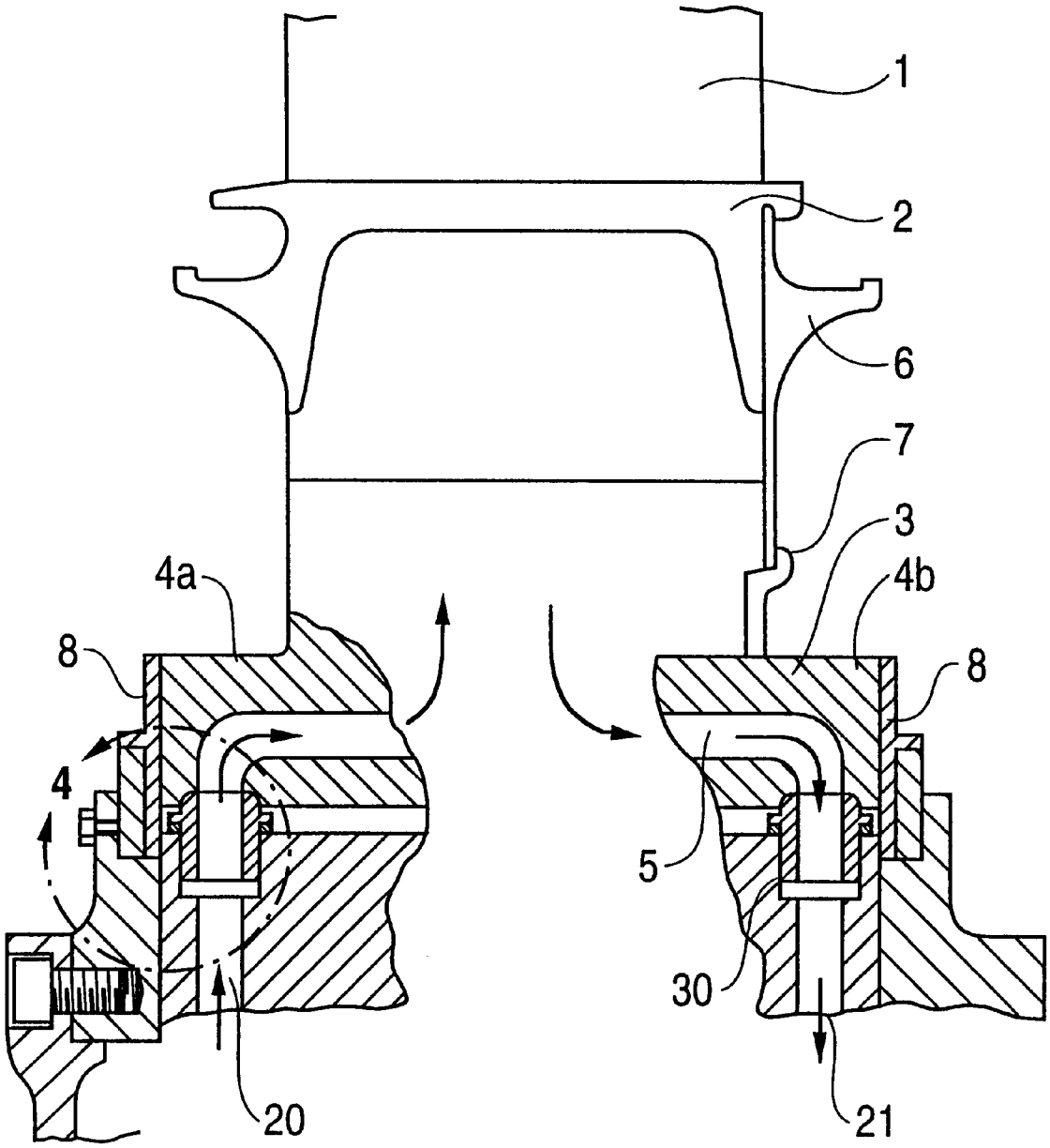
FIG. 3 is a cross sectional view of a blade root portion which is applied to a gas turbine moving blade steam cooling system of a second embodiment according to the present invention.

FIG. 3 is a cross sectional view of a blade root portion which is applied to a gas turbine moving blade steam cooling system of a second embodiment according to the present invention. In FIG. 3, numerals 1 to 6, 8, 20 and 21 designate respectively the same parts as those of the first embodiment shown in FIG. 1 and thus, the description thereof is omitted. The second embodiment includes a pipe-like joint 30, which will be described below.

In FIG. 3, each end portion along a turbine axial direction of a blade root portion 3 is projected, as compared with the prior art, so as to form a projection portion 4*a,* 4*b* and a steam passage 5 has opposite end portions which extend downwardly in the projection portions 4*a* and 4*b,* respectively. At end portions of the steam passage 5, at steam supply passage 20 and at steam recovery passage 21, respectively, there are provided mounting portions 33, 34 in which the end portions of the steam passage 5 and the end portions of the steam supply passage 20 and the steam recovery passage 21 are worked so that the pipe-like joint 30 may be inserted thereinto.

Figure 4:
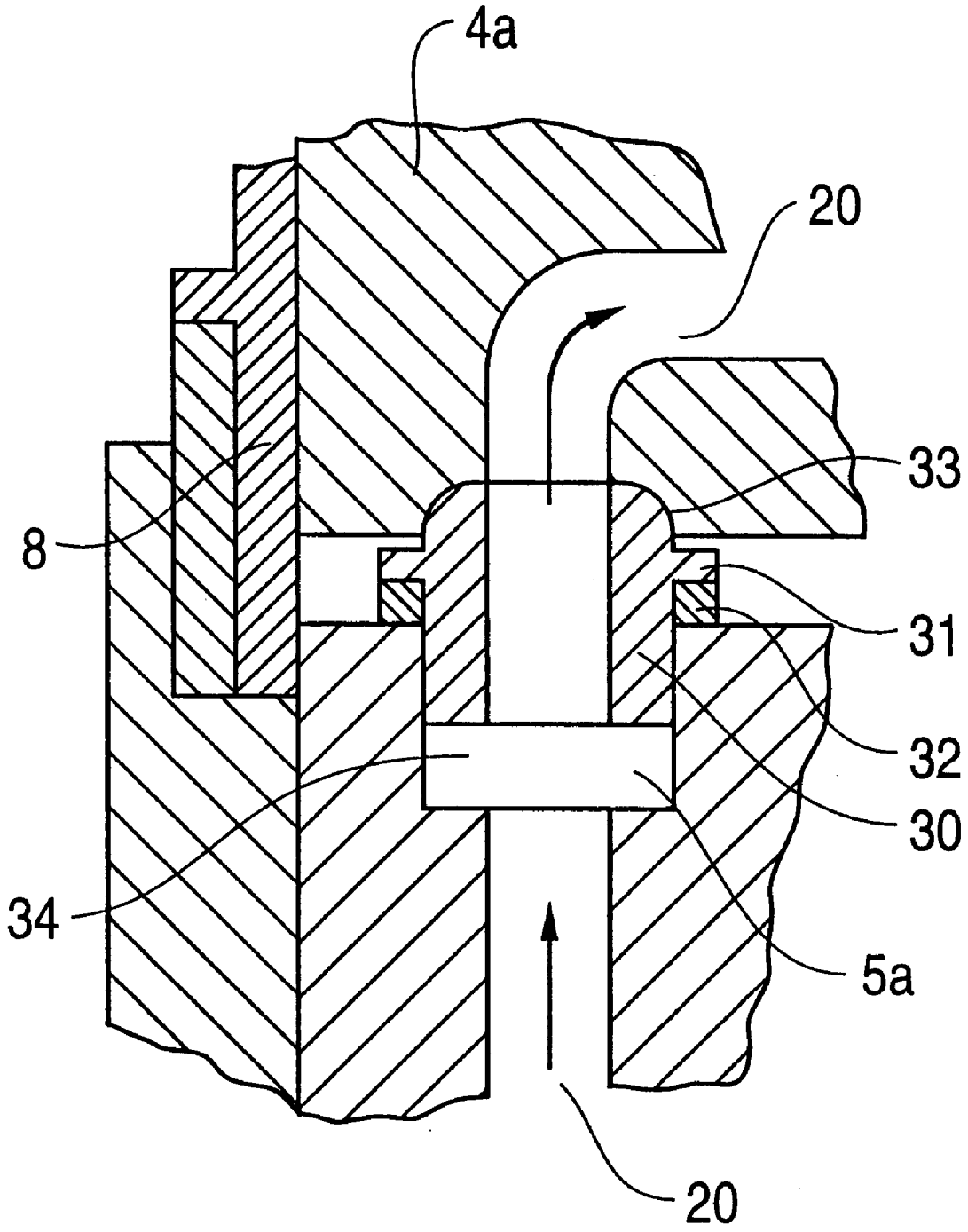
FIG. 4 is an enlarged detailed view of portion B of FIG. 3 showing the mounting for a pipe-like joint.
Figure 5A:
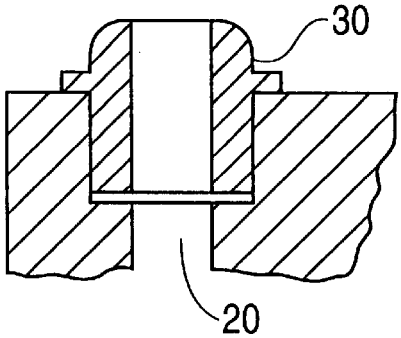
FIGS. 5(*a*) to (*d*) show procedures of mounting the pipe-like joint of FIG. 4.
Figure 5B:
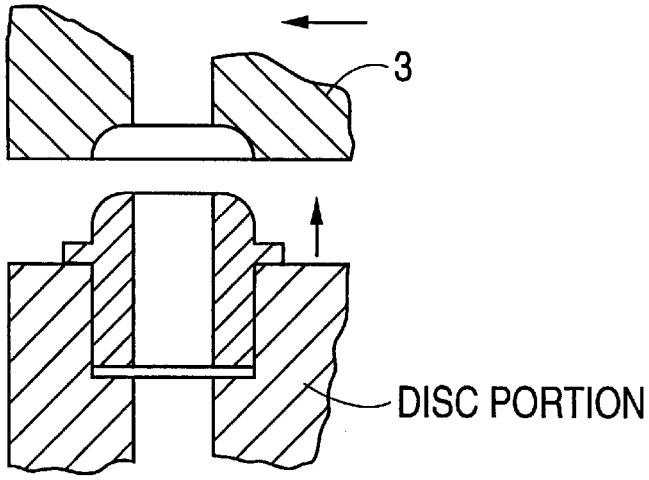
Figure 5C:
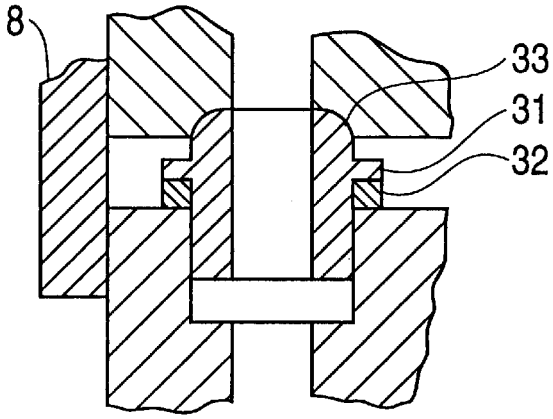
Figure 5D:
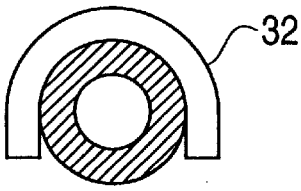

FIG. 4 is an enlarged detailed view of portion B of FIG. 3 showing the mounting of the pipe-like joint 30. FIGS. 5(*a*) to (*d*) show procedures of mounting. The mounting portion 33 on the blade side of the pipe-like joint 30 is made in a round shape for good mountability and the mounting portion 34 on the disc side of the same is made in a regular cylindrical shape for providing good slidability. A flange-like projection portion 31 is formed on upper side of the pipe-like joint 30. Numeral 32 designates a fixing piece for fixing the pipe-like joint 30.

Procedures of mounting the pipe-like joint 30 will be described. As shown in FIG. 5(*a*), the pipe-like joint 30 is first inserted into the disc side mounting portion 34, then as shown in FIG. 5(*b*), the blade is inserted from the right hand side in the figure to a predetermined position above the disc portion. Upon the blade being so mounted onto the disc portion, as shown in FIG. 5(*c*), the pipe-like joint 30 is lifted toward the blade side mounting portion 34 to be fitted therein. Then, the fixing piece 32, having a horseshoe shape is fitted in between the projection portion 31 of the pipe-like joint 30 and the disc for providing a secure fixing. Even if the fixing piece 32 is not used, the pipe-like joint 30 is moved well toward the blade side mounting portion 33 by action of centrifugal force due to rotation and a secure mounting can be attained. It is to be noted that demounting of the pipe-like joint 30 can be performed easily by reverse procedures of those mentioned above.

Figure 6:
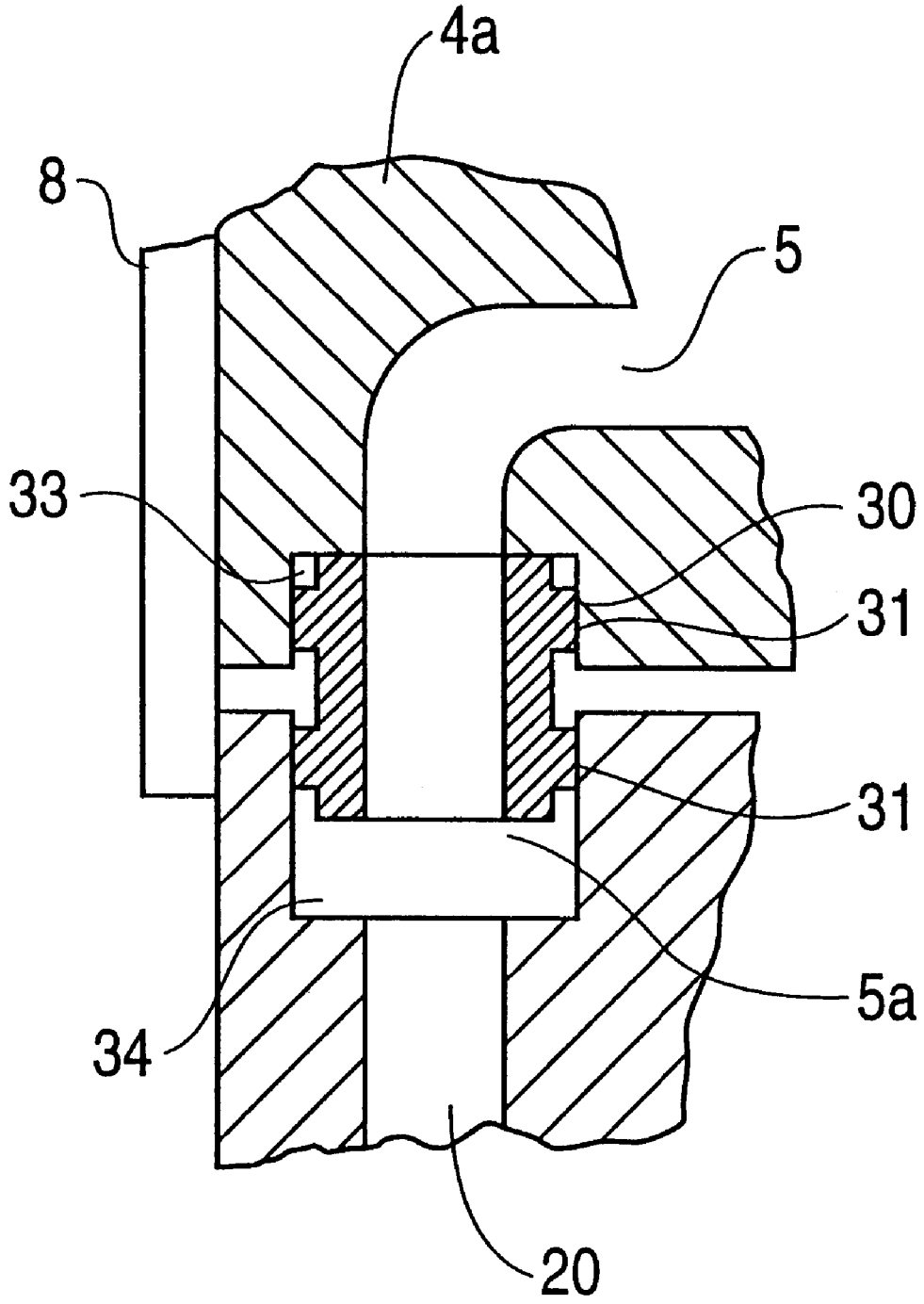
FIG. 6 is a cross sectional view showing another example of the pipe-like joint of FIG. 4.

FIG. 6 is a cross sectional view showing another example of the pipe-like joint 30 of the second embodiment, which is basically the same as that shown in FIGS. 3 and 4 except that the pipe-like joint 30 of the present example has a flange-like projection portion 31 on its upper portion and its lower portion. The projection portion 31 is slidable in a blade side mounting portion 33 and in a disc side mounting portion 34, and the pipe-like joint 30 slides upwardly due to action of a centrifugal force so as to cause a blade side steam passage and a disc side steam passage to communicate with each other. It is to be noted that the shape of the pipe-like joint is not limited to those shown in the figures but may naturally be used with modified forms.

Also, in the second embodiment cooling steam is supplied from the steam supply passage 20 to flow through the steam passage 5 in the projection portion 4*a*. And, after cooling the blade interior, the cooling steam is recovered through the steam recovery passage 21 in the projection portion 4*b*. Hence, the same effect as that of the first embodiment can be obtained. Further, by use of the pipe-like joint 30 which is demountable, inspection of the passages of the steam cooling system is facilitated.

Figure 7:
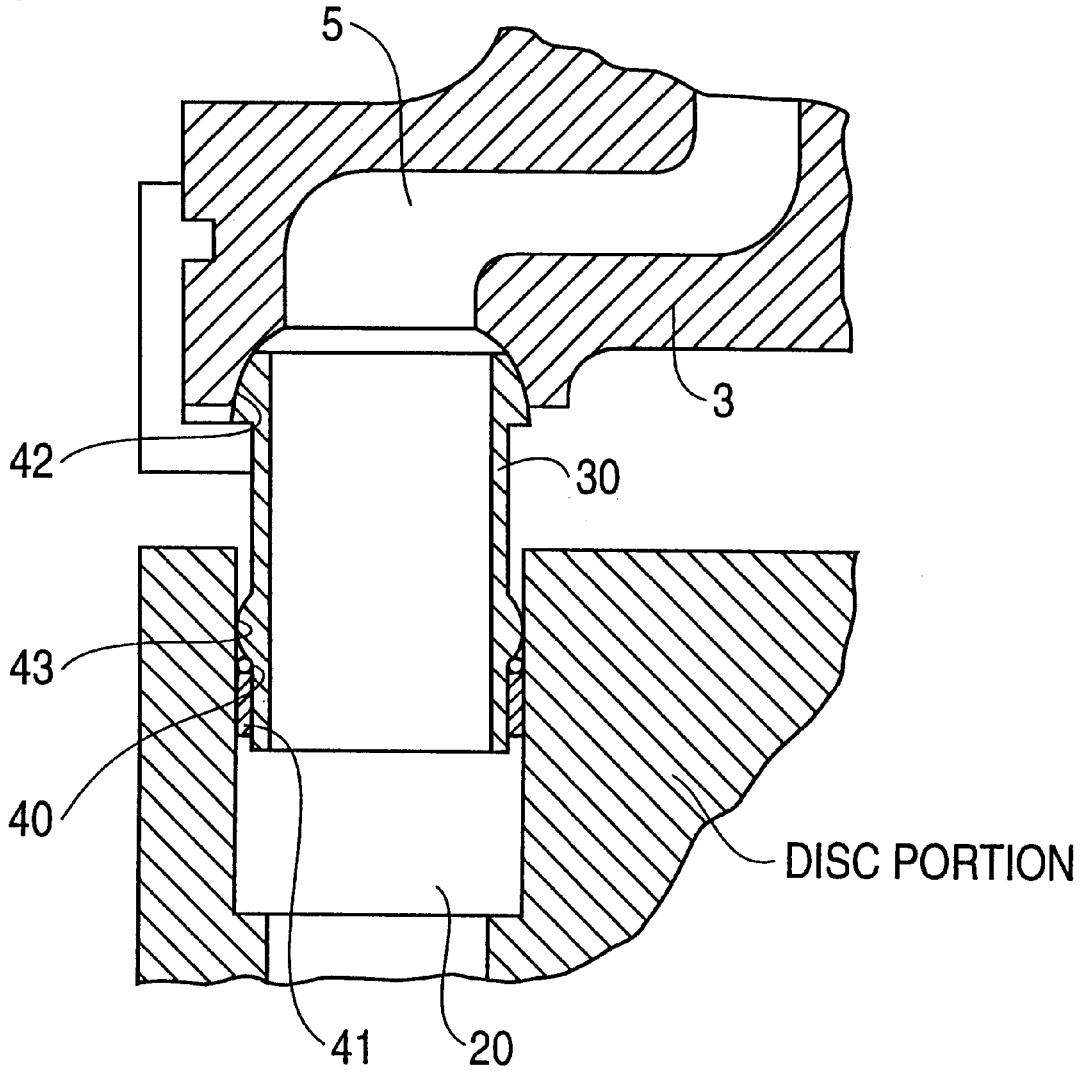
FIG. 7 is a cross sectional view of a main part of a blade root portion which is applied to a gas turbine moving blade steam cooling system in accordance with a third embodiment of the present invention.
Figure 8:
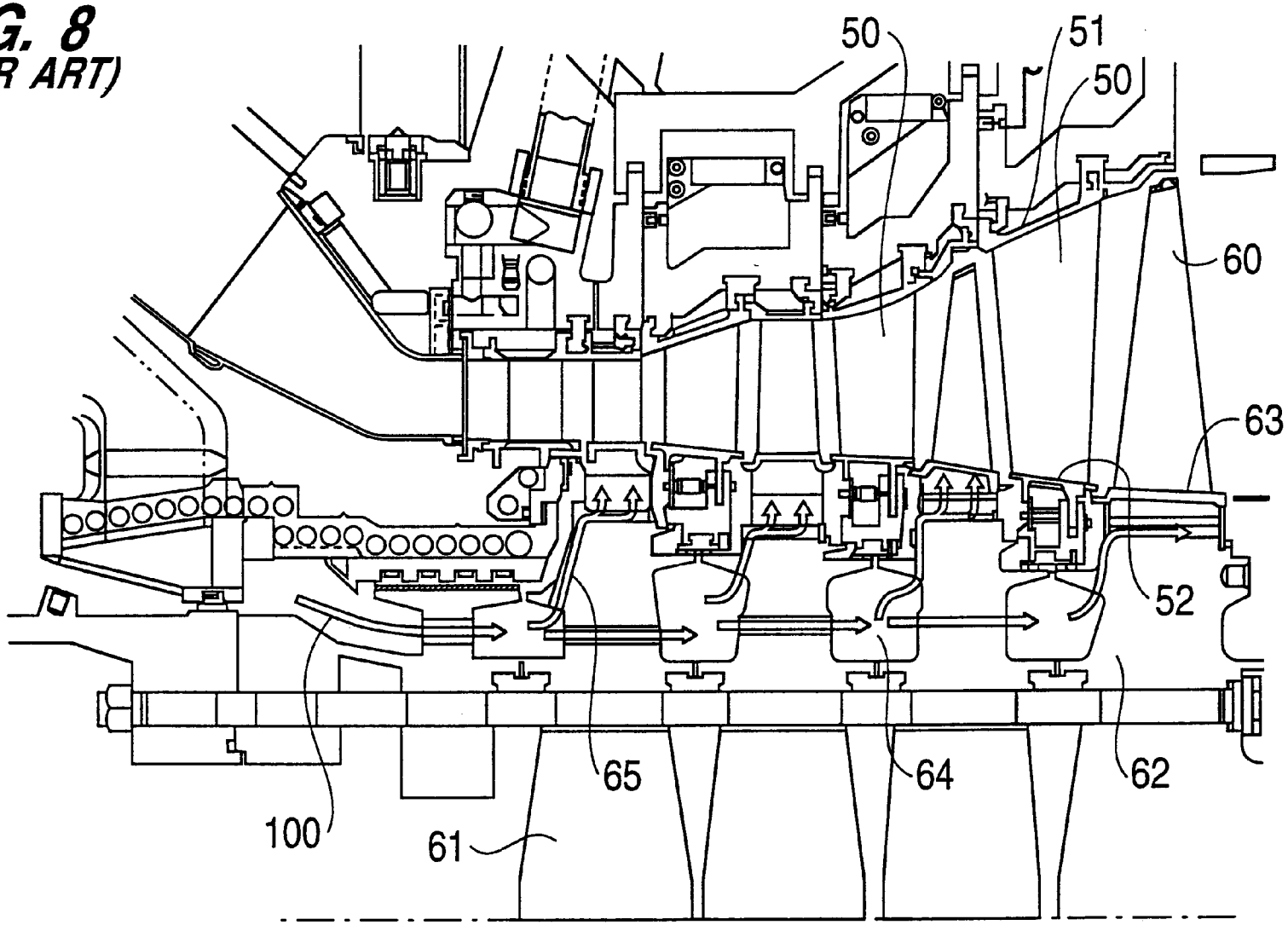
FIG. 8 (PRIOR ART)
FIG. 8 is a cross sectional view of a prior art gas turbine interior and shows flows of cooling air in a moving blade portion.
Figure 9:
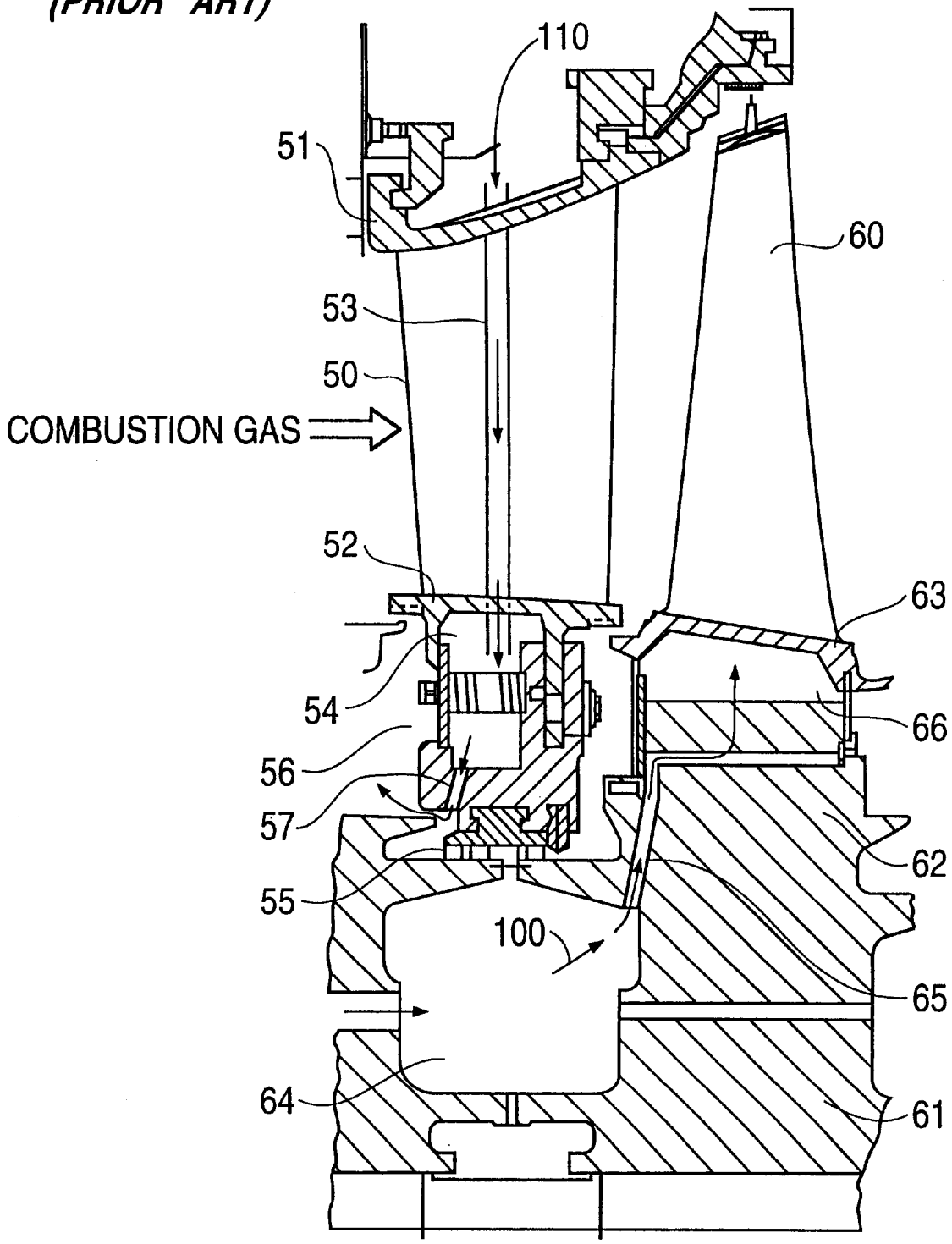
FIG. 9 (PRIOR ART)
FIG. 9 is a cross sectional view of a moving blade portion and a stationary blade portion of the prior art gas turbine.

FIG. 7 is a cross sectional view of a main part of a blade root portion which is applied to a gas turbine moving blade steam cooling system of a third embodiment according to the present invention. In FIG. 7, the same part as that shown in the first and second embodiments are designated with the same reference numerals and description thereof is omitted to the extent possible.

A pipe-like joint 30 causes a steam passage 5 of a blade root portion 3 of turbine blade and a steam supply passage 20 of disc portion to communicate with each other and forms at its lower portion a disc side seal point 43 of which a central portion has a spherical surface of a small radius of curvature and abuts on the blade root portion. An O-ring 40 is provided on a turbine rotational center side of the disc side seal point 43 and an O-ring support bush 41 abutting on the O-ring on a further turbine rotational center side thereof.

Also, at an upper portion of the pipe-like joint 30, a blade side seal point 42 is formed. The seal point 42 has a spherical surface of a large radius of curvature and abuts on the blade root portion 3. Thus, the pipe-like joint 30 is so constructed.

In the present embodiment constructed as above, there is provided the blade side seal point 42 of the pipe-like joint 30 which has a spherical surface of large radius of curvature and abuts on the blade root portion 3 so as to be able to maintain seal surface pressure due to centrifugal force. Also, the disc side seal point 43 of the pipe-like joint 30, which cannot receive the seal surface pressure due to centrifugal force, but can obtain a seal by engaging a surface of the disc portion, hence sealing of the pipe-like joint 30 is attained well.

Even if wear of the disc side sealing point 43 is experienced due to vibration and the like following a certain operation period the O-ring 40 is provided on the turbine rotational center side of the disc side seal point 43, thereby the sealing function can be maintained and deterioration of the entire sealing ability can be prevented.

The O-ring support bush 41, provided on the turbine rotational center side of the O-ring 40, receives centrifugal force acting thereon so as to enhance seal surface pressure of the O-ring 40, thereby the sealing function can be maintained stably.

The present invention has been described with respect to the embodiments illustrated in the figures but the present invention is not to be limited thereto but, needless to mention, may include various modifications within the scope of claims as set forth hereinbelow.

According to the present invention, the following effects can be obtained.

In the invention described above, the gas turbine moving blade steam cooling system includes a moving blade which is fitted to a blade root portion via a platform. A projection portion projects from each end along a turbine axial direction of an upper portion of the blade root portion which is under the platform and a steam passage, provided along the turbine axial direction between each projection portion, communicates with a steam passage of the moving blade. The steam passage has a steam supply port in one of the projection portions and a steam recovery port in the other of the projecting portions so that the steam supply port and the steam recovery port are connected to a steam supply passage and a steam recovery passage, respectively, on a disc side of the blade.

Thereby, the cooling steam enters the steam passage from the steam supply passage to cool the blade interior and passes through the steam passage again and through the steam recovery port to be recovered in the steam recovery passage and leakage of steam can be prevented. Further, because the steam supply port and the steam recovery port are provided in the projection portions, stress concentration due to heat at the blade root end portions can be avoided due to the shape of the projection portions and the strength of the blade root portion can be enhanced.

In the invention described above, the gas turbine moving blade steam cooling system includes a demountable joint pipe at each of the steam supply port and the steam recovery port of the steam passage so that a lower portion of the joint pipes are connected to the steam supply passage and the steam recovery passage, respectively.

Thereby, inspection and repair of the steam passages is facilitated and replacement of the joint pipe becomes possible, thus reliability of steam cooling of the moving blade is enhanced.

Further, in the present invention, the gas turbine moving blade steam cooling system is provided a seal plate for sealing each side surface and therebetween along a turbine rotational direction of each said projection portion of mutually adjacent moving blades.

Thus, steam leakage can be prevented securely by the seal plates.

Further, in the present invention, the gas turbine moving blade steam cooling system includes a pipe-like joint which causes a steam supply passage or a steam recovery passage provided in a disc portion to communicate with a steam passage provided in a blade root portion. An O-ring is provided on a turbine rotational center side of a seal point of the pipe-like joint and a bush is provided on the turbine rotational center side of the O-ring so as to abut the O-ring.

Thus, by use of the O-ring provided on the turbine rotational center side of the seal point of the pipe-like joint which is located at a place where there may occur wearing due to vibration, even if wear of the seal point occurs, the sealing is well maintained so as to prevent deterioration of the sealing ability. Moreover, by use of the bush abutting on the turbine rotational center side of the O-ring, seal surface pressure of the O-ring is enhanced by action of the centrifugal force and sealing ability is further stabilized and strengthened. Hence, the sealing at the portions from the disc to the moving blade of the gas turbine is maintained securely so as to attain a high sealing ability.

What is claimed is:

1. A gas turbine moving blade cooling system comprising:

a moving blade having a platform;

a blade root portion disposed under and fitted to said platform, said blade root portion including a first projecting portion which projects along a turbine axial direction of an upper portion of said blade root portion, a second projecting portion which projects in an opposite direction of said first projecting portion along the turbine axial direction of the upper portion of said blade root portion, and a steam passage extending along the turbine axial direction between said first and second projecting portions, said steam passage communicating with a cooling passage formed in said moving blade, wherein said steam passage has a steam supply port opening downwardly in said first projecting portion, and a steam recovery port opening downwardly in said second projecting portion such that said steam supply port and said steam recovery port can be connected to a steam supply passage and a steam recovery passage, respectively.

2. A gas turbine moving blade steam cooling system as claimed in claim 1, further comprising:

a first seal plate disposed along a turbine rotational direction of said first projecting portion for sealing a side surface of said first projecting portion; and a second seal plate disposed along a turbine rotational direction of said second projecting portion for sealing a side surface of said second projecting portion.

3. A gas turbine moving blade steam cooling system as claimed in claim 1, further comprising:

a first removable joint pipe connected to said steam supply port, wherein a lower portion of said first removable joint pipe is adapted to be connected to the steam supply passage; and a second removable joint pipe connected to said steam recovery port, wherein a lower portion of said second removable joint pipe is adapted to be connected to the steam recovery passage.

4. A gas turbine moving blade steam cooling system as claimed in claim 3, wherein said first removable pipe joint includes a rounded end portion which is received in a recessed portion of said first projecting portion at said steam supply port, an outwardly extending flange portion adjacent said rounded end portion, and a fixing piece disposed on an opposite side of said flange portion relative to said rounded end portion.

5. A gas turbine moving blade steam cooling system as claimed in claim 3, further comprising:

a first seal plate disposed along a turbine rotational direction of said first projecting portion for sealing a side surface of said first projecting portion; and a second seal plate disposed along a turbine rotational direction of said second projecting portion for sealing a side surface of said second projecting portion.

6. A gas turbine moving blade steam cooling system comprising:

a pipe-like joint for causing a steam supply passage or a steam recovery passage, provided in a disc portion, to communicate with a steam passage formed in a blade root portion, said pipe-like joint having a seal portion contacting a surface of said disc portion;

an o-ring provide on a turbine rotational center side of said seal portion of said pipe-like joint; and a bushing abutting said o-ring, said bushing being provided on the turbine rotational center side of said o-ring.

7. A gas turbine moving blade cooling system comprising:

a disc portion having a steam supply passage and a steam recovery passage;

a movable blade having a platform and a blade portion defining a cooling passage therein;

a blade root portion fitted to said platform and connected to said disc portion, said blade root portion including a first projecting portion which projects along a turbine axial direction of an upper portion of said blade root portion, a second projecting portion which projects in an opposite direction of said first projecting portion along the turbine axial direction of the upper portion of said blade root portion, and a steam passage extending along the turbine axial direction between said first and second projecting portions, said steam passage communicating with a cooling passage formed in said moving blade, wherein said steam passage has a steam supply port opening downwardly in said first projecting portion so as to communicate with said steam supply passage, and a steam recovery port opening downwardly in said second projecting portion so as to communicate with said steam recovery passage.

8. A gas turbine moving blade steam cooling system as claimed in claim 7, further comprising:

a first removable joint pipe having a radially outer end communicating with said steam supply port and a radially inner end inserted in said steam supply passage; and a second removable joint pipe having a radially outer end communicating with said steam recovery port and a radially inner end inserted in said steam recovery passage.

9. A gas turbine moving blade steam cooling system as claimed in claim 8, wherein each of said first and second removable pipe joints includes an outwardly extending flange portion adjacent said radially outer end, and a fixing piece disposed between said flange portion and said disc portion.

10. A gas turbine moving blade steam cooling system as claimed in claim 8, wherein:

said first removable pipe joint has a first flange portion projecting outwardly into contact with an inner peripheral surface of said steam supply port, and a second flange portion projecting outwardly into contact with an inner peripheral surface of said steam supply passage; and said second removable pipe joint has a first flange portion projecting outwardly into contact with an inner peripheral surface of said steam recovery port, and a second flange portion projecting outwardly into contact with an inner peripheral surface of said steam recovery passage.

11. A gas turbine moving blade steam cooling system as claimed in claim 8, wherein said first removable pipe joint comprises:

a seal portion contacting a surface of said disc portion;

an o-ring provided on a turbine rotational center side of said seal portion; and a bushing abutting said o-ring, said bushing being provided on the turbine rotational center side of said o-ring.

* * * * *